US010026538B2

(12) United States Patent
Takezawa

(10) Patent No.: US 10,026,538 B2
(45) Date of Patent: Jul. 17, 2018

(54) ELECTRONIC COMPONENT WITH MULTILAYERED BODY

(71) Applicant: MURATA MANUFACTURING CO., LTD., Kyoto-fu (JP)

(72) Inventor: Kaori Takezawa, Kyoto-fu (JP)

(73) Assignee: Murata Manufacturing Co., Ltd., Kyoto-fu (JP)

( * ) Notice: Subject to any disclaimer, the term of this patent is extended or adjusted under 35 U.S.C. 154(b) by 30 days.

(21) Appl. No.: 14/837,525

(22) Filed: Aug. 27, 2015

(65) Prior Publication Data

US 2015/0371757 A1 Dec. 24, 2015

Related U.S. Application Data

(63) Continuation of application No. PCT/JP2014/055645, filed on Mar. 5, 2014.

(30) Foreign Application Priority Data

Mar. 7, 2013 (JP) ..... 2013-044978

(51) Int. Cl.
*H01F 27/28* (2006.01)
*H01F 17/00* (2006.01)
*H01F 27/29* (2006.01)

(52) U.S. Cl.
CPC ..... *H01F 27/2804* (2013.01); *H01F 17/0013* (2013.01); *H01F 27/292* (2013.01); *H01F 2027/2809* (2013.01)

(58) Field of Classification Search
CPC ..... H01F 27/2804; H01F 2027/2809; H01F 17/0013
See application file for complete search history.

(56) References Cited

U.S. PATENT DOCUMENTS

2008/0257488 A1* 10/2008 Yamano ..... H01F 17/0013 156/272.4
2013/0015937 A1* 1/2013 Seko ..... H01F 17/0013 336/200

FOREIGN PATENT DOCUMENTS

JP H11214235 A * 8/1999 ..... H01F 17/00
JP 2012079870 A * 4/2012 ..... H01F 27/29
(Continued)

OTHER PUBLICATIONS

JP2012079870A, Apr. 2012, Machine Translation.*
(Continued)

*Primary Examiner* — Elvin G Enad
*Assistant Examiner* — Malcolm Barnes
(74) *Attorney, Agent, or Firm* — Studebaker & Brackett PC

(57) ABSTRACT

A multilayer body is a lamination of a plurality of substantially rectangular insulating layers and has a bottom surface being a series of the outer edges of the insulating layers, an end surface being adjacent to the bottom surface and being a series of the outer edges of the insulating layers, and a side surface located on a negative side in the y-axis direction. An outer electrode is embedded in the multilayer body such that it is exposed while extending across the boundary between the bottom surface and the end surface. A coil is disposed in the multilayer body and is connected to the outer electrode. The distance between the outer electrode and the side surface in the corner between the bottom surface and the end surface is longer than the distance between the outer electrode and the side surface where the outer electrode and the coil are connected.

1 Claim, 11 Drawing Sheets

(56) References Cited

FOREIGN PATENT DOCUMENTS

| | | | | |
|---|---|---|---|---|
| JP | 2008-060214 | A | 2/2013 | |
| JP | 2013-038392 | A | 2/2013 | |
| WO | WO2011155240 | A1 * | 12/2011 | ..... H01F 27/29 |

OTHER PUBLICATIONS

JPH11214235A, Aug. 1999, Machine Translation.*
International Search Report and Written Opinion of the International Searching Authority, PCT/JP2014/055645, dated May 27, 2014.

* cited by examiner

ELECTRONIC COMPONENT WITH MULTILAYERED BODY

CROSS-REFERENCE TO RELATED APPLICATIONS

This application claims benefit of priority to Japanese Patent Application No. 2013-044978 filed Mar. 7, 2013, and the International Patent Application No. PCT/JP2014/055645 filed Mar. 5, 2014, the entire content of each of which is incorporated herein by reference.

TECHNICAL FIELD

The present disclosure relates to electronic components and, in particular, an electronic component including a multilayer body in which a plurality of insulating layers are laminated.

BACKGROUND

One known example of an electronic component in related art is a multilayer chip inductor 500 described in Japanese Unexamined Patent Application Publication No. 2012-79870. FIG. 18 is a perspective view of the multilayer chip inductor 500 described in Japanese Unexamined Patent Application Publication No. 2012-79870.

The multilayer chip inductor 500 includes a multilayer body 501 and outer electrodes 502. The multilayer body 501 is a lamination of insulating sheets. The outer electrodes 502 are embedded in the multilayer body 501 and exposed at two surfaces of the multilayer body 501.

The multilayer chip inductor 500 described in Japanese Unexamined Patent Application Publication No. 2012-79870 has a problem that chipping is likely to occur in the multilayer body 501. As illustrated in FIG. 18, the insulating layers are laminated on the upper and lower sides of the outer electrodes 502. Thus the outer electrodes 502 are not exposed at the upper and lower surfaces of the multilayer body 501.

In the viewpoint of miniaturization of the multilayer chip inductor 500, the distance between each of the outer electrodes 502 and each of the upper and lower surfaces may preferably be reduced by a reduction in the thickness of the insulating layers laminated on the upper and lower sides of the outer electrodes 502. When the distance between each of the outer electrodes 502 and the upper or lower surface is reduced, chipping may occur in a portion above or below the outer electrode 502 in the multilayer body 501 in a barrel polishing process or the like for the multilayer body 501.

SUMMARY

Technical Problem

It is an object of the present disclosure to provide an electronic component capable of suppressing the occurrence of chipping in a multilayer body.

Solution to Problem

An electronic component according to a first embodiment of the present disclosure includes a multilayer body in which a plurality of substantially rectangular insulating layers are laminated, the multilayer body having a bottom surface being a series of outer edges of the plurality of insulating layers, a first end surface being adjacent to the bottom surface and being a series of the outer edges of the plurality of insulating layers, and a first side surface being located on a first side in a laminating direction, a first outer electrode embedded in the multilayer body such that the first outer electrode is exposed from the multilayer body while extending across a boundary between the bottom surface and the first end surface, and a circuit element disposed in the multilayer body and connected to the first outer electrode. A distance between the first outer electrode and the first side surface in a corner between the bottom surface and the first end surface is longer than a distance between the first outer electrode and the first side surface in a portion where the first outer electrode and the circuit element are connected.

An electronic component according to a second embodiment of the present disclosure includes a multilayer body in which a plurality of substantially rectangular insulating layers are laminated, the multilayer body having a bottom surface being a series of outer edges of the plurality of insulating layers, a first end surface being adjacent to the bottom surface and being a series of the outer edges of the plurality of insulating layers, and a first side surface being located on a first side in a laminating direction, a first outer electrode embedded in the multilayer body such that the first outer electrode is exposed from the multilayer body while extending across a boundary between the bottom surface and the first end surface, and a circuit element disposed in the multilayer body and connected to the first outer electrode. The first outer electrode has a shape that protrudes in the laminating direction in a portion other than a corner between the bottom surface and the first end surface. The circuit element is connected to the portion protruding in the laminating direction in the first outer electrode.

Advantageous Effects of Disclosure

According to the present disclosure, the occurrence of chipping in a multilayer body can be suppressed.

DETAILED DESCRIPTION

An electronic component according to an embodiment of the present disclosure is described below.

Configuration of Electronic Component

Figure 1:
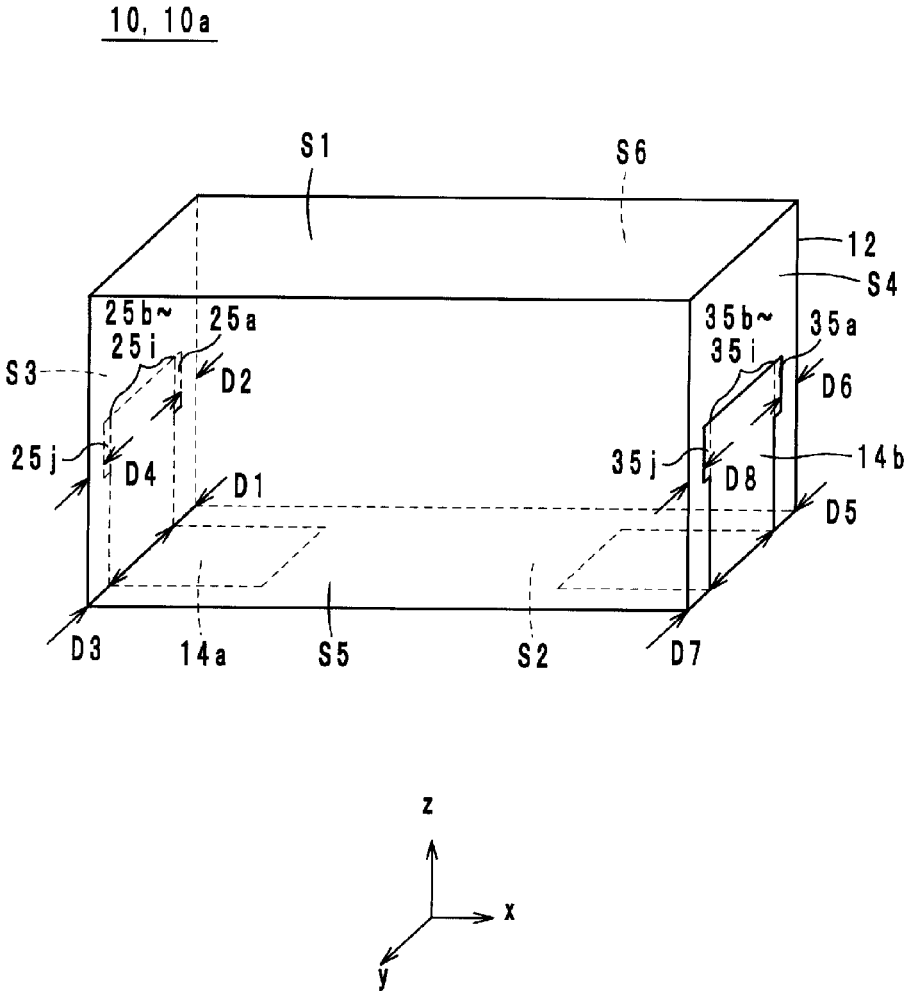
FIG. 1 is an external perspective view of an electronic component according to an embodiment.
Figure 2:
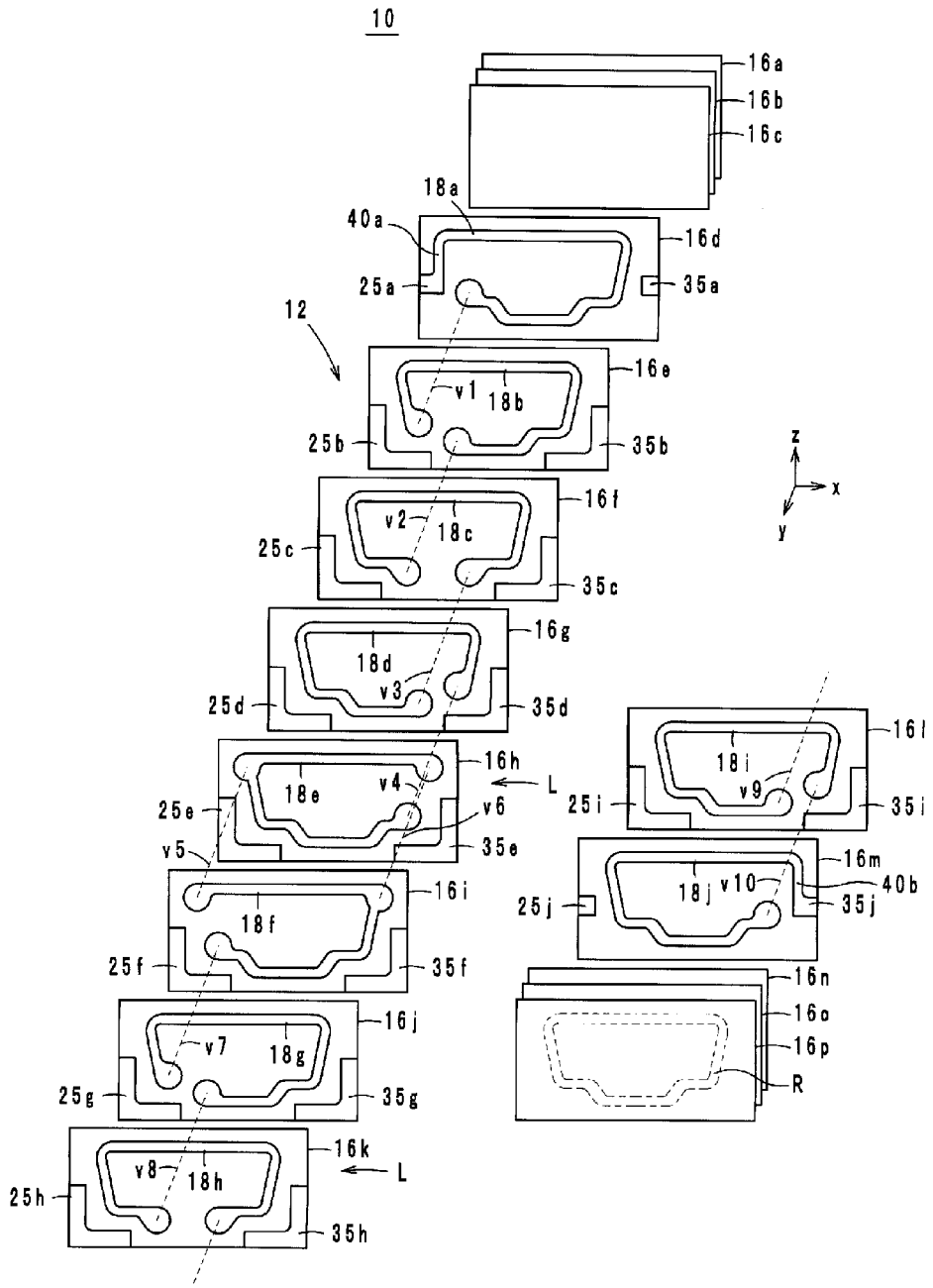
FIG. 2 is an exploded perspective view of the electronic component illustrated in FIG. 1.

A configuration of an electronic component according to an embodiment is described below with reference to the drawings. FIG. 1 is an external perspective view of an electronic component 10 according to the embodiment. FIG. 2 is an exploded perspective view of the electronic component 10 illustrated in FIG. 1. Hereinafter, the laminating direction of the electronic component 10 is defined as a y-axis direction. The direction in which the long sides of the electronic component 10 extend is defined as an x-axis direction, and the direction in which the short sides of the electronic component 10 extend is defined as a z-axis direction, as seen from the y-axis direction in plan view.

As illustrated in FIGS. 1 and 2, the electronic component 10 includes a multilayer body 12, outer electrodes 14*a* and 14*b*, extended conductors 40*a* and 40*b*, and a coil L (circuit element).

As illustrated in FIG. 2, the multilayer body 12 includes a plurality of insulating layers 16*a* to 16*p* laminated and arranged in this order from the negative side toward the positive side in the y-axis direction and has a substantially rectangular parallelepiped shape. The multilayer body 12 has an upper surface S1, a bottom surface S2, end surfaces S3 and S4, and side surfaces S5 and S6. The upper surface S1 is the positive-side surface of the multilayer body 12 in the z-axis direction. The bottom surface S2 is the negative-side surface of the multilayer body 12 in the z-axis direction and is a mounting surface that faces a circuit board when the electronic component 10 is mounted on the circuit board. The upper surface S1 is a series of the long sides of the insulating layers 16*a* to 16*p* on the positive side in the z-axis direction, and the bottom surface S2 is a series of the long sides of the insulating layers 16*a* to 16*p* on the negative side in the z-axis direction. The end surfaces S3 and S4 are the negative-side surface and the positive-side surface of the multilayer body 12 in the x-axis direction, respectively. The end surface S3 is a series of the short sides of the insulating layers 16*a* to 16*p* on the negative side in the x-axis direction, and the end surface S4 is a series of the short sides of the insulating layers 16*a* to 16*p* on the positive side in the x-axis direction. The end surfaces S3 and S4 are adjacent to the bottom surface S2. The side surfaces S5 and S6 are the positive-side surface and the negative-side surface of the multilayer body 12 in the y-axis direction, respectively.

As illustrated in FIG. 2, each of the insulating layers 16*a* to 16*p* is substantially rectangular and may be made of an insulating material that has a borosilicate glass as a main ingredient. Hereinafter, the positive-side surface of each of the insulating layers 16*a* to 16*p* in the y-axis direction is referred to as a front surface, and the negative-side surface of each of the insulating layers 16*a* to 16*p* in the y-axis direction is referred to as a back surface.

The coil L includes coil conductors 18*a* to 18*j* and via-hole conductors v1 to v10. The coil L is configured by connecting the coil conductors 18*a* to 18*j* by the via-hole conductors v1 to v10. The coil L has a winding axis extending along the y-axis direction and has a spiral shape that is wound clockwise while extending from the negative side to the positive side in the y-axis direction as seen from the positive side in the y-axis direction in plan view.

The coil conductors 18*a* to 18*j* are disposed on the front surfaces of the insulating layers 16*d* to 16*m*, respectively. The coil conductors 18*a* to 18*j* overlap one another and form an annular route R as seen in the y-axis direction in plan view. The route R has a substantially isosceles trapezoid shape in which the upper base is longer than the lower base. The two corners on the lower base and their surroundings in the route R are recessed inward in the route R so as not to be in contact with the outer electrodes 14*a* and 14*b*.

Each of the coil conductors 18*a* to 18*j* has a structure in which the route R is partly cut and is a linear conductor wound clockwise. Hereinafter, the end portion of each of the coil conductors 18*a* to 18*j* on the downstream side in the clockwise direction as seen from the positive side in the y-axis direction in plan view is referred to simply as the downstream end, and the end portion of each of the coil conductors 18*a* to 18*j* on the upstream side in the clockwise direction as seen from the positive side in the y-axis direction in plan view is referred to simply as the upstream end.

The coil conductors 18*a* to 18*j* having the above-described configuration may be made of a conductive material whose main ingredient is silver.

The via-hole conductors v1 to v4 extend through the insulating layers 16*e* to 16*h*, respectively, along the y-axis direction. The via-hole conductors v5 and v6 extend through the insulating layer 16*i* along the y-axis direction. The via-hole conductors v7 to v10 extend through the insulating layers 16*j* to 16*m*, respectively, along the y-axis direction.

The via-hole conductor v1 connects the downstream end of the coil conductor 18*a* and the upstream end of the coil conductor 18*b*. The via-hole conductor v2 connects the downstream end of the coil conductor 18*b* and the upstream end of the coil conductor 18*c*. The via-hole conductor v3 connects the downstream end of the coil conductor 18*c* and the upstream end of the coil conductor 18*d*. The via-hole conductor v4 connects the downstream end of the coil conductor 18*d* and the upstream end of the coil conductor 18*e*.

The via-hole conductor v5 connects the negative-side end portion of the upper base of the coil conductor 18*e* in the x-axis direction and the upstream end of the coil conductor 18*f*. The via-hole conductor v6 connects the downstream end of the coil conductor 18*e* and the positive-side end portion of the upper base of the coil conductor 18*f* in the x-axis direction.

The via-hole conductor v7 connects the downstream end of the coil conductor 18*f* and the upstream end of the coil conductor 18*g*. The via-hole conductor v8 connects the downstream end of the coil conductor 18*g* and the upstream end of the coil conductor 18*h*. The via-hole conductor v9 connects the downstream end of the coil conductor 18*h* and the upstream end of the coil conductor 18*i*. The via-hole conductor v10 connects the downstream end of the coil conductor 18*i* and the upstream end of the coil conductor 18*j*.

The via-hole conductors v1 to v10 may be made of a conductive material whose main ingredient is silver.

As illustrated in FIG. 1, the outer electrode 14*a* is embedded in the multilayer body 12 such that it is exposed from the multilayer body 12 while extending across the boundary between the bottom surface S2 and the end surface S3. The outer electrode 14*a* is L-shaped as seen in the y-axis direction in plan view. As illustrated in FIG. 2, the outer electrode 14*a* is a lamination of outer conductors 25*a* to 25*j*.

As illustrated in FIG. 2, the outer conductor 25*a* is disposed on the front surface of the insulating layer 16*d*. The outer conductor 25*a* is substantially rectangular and lies in the vicinity of the center of the short side of the insulating layer 16*d* on the negative side in the x-axis direction. As illustrated in FIG. 2, the outer conductors 25*b* to 25*i* extend through the insulating layers 16*e* to 16*l*, respectively, along the y-axis direction. The outer conductors 25*b* to 25*i* are L-shaped and are disposed in the respective corners at which the short sides of the insulating layers 16*e* to 16*l* on the negative side in the x-axis direction intersect with the long sides thereof on the negative side in the z-axis direction as seen in the y-axis direction in plan view. As illustrated in FIG. 2, the outer conductor 25*j* extends through the insulating layer 16*m* along the y-axis direction. The outer conductor 25*j* is substantially rectangular and lies in the vicinity of the center of the short side of the insulating layer 16*m* on the negative side in the x-axis direction. The outer conductors 25*a* to 25*j* are electrically connected together by being laminated.

The outer electrode 14*a* is substantially rectangular at the end surface S3 as seen from the negative side in the x-axis direction in plan view. The outer conductors 25*b* to 25*i* have the same shape, whereas each of the outer conductors 25*a* and 25*j* is smaller than each of the outer conductors 25*b* to 25*i*. Accordingly, as illustrated in FIG. 1, the outer conductor 25*a* protrudes from the long side of the portion where the outer electrode 14*a* is exposed at the end surface S3 on the negative side in the y-axis direction, toward the negative side in the y-axis direction. Similarly, as illustrated in FIG. 1, the outer conductor 25*j* protrudes from the long side of the portion where the outer electrode 14*a* is exposed at the end surface S3 on the positive side in the y-axis direction, toward the positive side in the y-axis direction. That is, the outer electrode 14*a* protrudes toward both sides in the y-axis direction in portions other than the corners between the bottom surface S2 and the end surface S3.

As illustrated in FIG. 1, the outer electrode 14*b* is embedded in the multilayer body 12 such that it is exposed from the multilayer body 12 while extending across the boundary between the bottom surface S2 and the end surface S4. The outer electrode 14*b* is L-shaped as seen in the y-axis direction in plan view. As illustrated in FIG. 2, the outer electrode 14*b* is a lamination of outer conductors 35*a* to 35*j*.

As illustrated in FIG. 2, the outer conductor 35*a* is disposed on the front surface of the insulating layer 16*d*. The outer conductor 35*a* is substantially rectangular and lies in the vicinity of the center of the short side of the insulating layer 16*d* on the positive side in the x-axis direction. As illustrated in FIG. 2, the outer conductors 35*b* to 35*i* extend through the insulating layers 16*e* to 16*l*, respectively, along the y-axis direction. The outer conductors 35*b* to 35*i* are L-shaped and are disposed in the respective corners at which the short sides of the insulating layers 16*e* to 16*l* on the positive side in the x-axis direction intersect with the long sides thereof on the negative side in the z-axis direction as seen in the y-axis direction in plan view. As illustrated in FIG. 2, the outer conductor 35*j* extends through the insulating layer 16*m* along the y-axis direction. The outer conductor 35*j* is substantially rectangular and lies in the vicinity of the center of the short side of the insulating layer 16*m* on the positive side in the x-axis direction. The outer conductors 35*a* to 35*j* are electrically connected together by being laminated.

The outer electrode 14*b* is substantially rectangular at the end surface S4 as seen from the positive side in the x-axis direction in plan view. The outer conductors 35*b* to 35*i* have the same shape, whereas each of the outer conductors 35*a* and 35*j* is smaller than each of the outer conductors 35*b* to 35*i*. Accordingly, as illustrated in FIG. 1, the outer conductor 35*a* protrudes from the long side of the portion where the outer electrode 14*b* is exposed at the end surface S4 on the negative side in the y-axis direction, toward the negative side in the y-axis direction. Similarly, as illustrated in FIG. 1, the outer conductor 35*j* protrudes from the long side of the portion where the outer electrode 14*b* is exposed at the end surface S4 on the positive side in the y-axis direction, toward the positive side in the y-axis direction. That is, the outer electrode 14*a* protrudes toward both sides in the y-axis direction in portions other than the corners between the bottom surface S2 and the end surface S4.

The extended conductor 40*a* is disposed on the front surface of the insulating layer 16*d* and connects the end portion of the coil conductor 18*a* on the upstream side in the clockwise direction and the outer conductor 25*a*. The extended conductor 40*a* does not overlap the route R. The coil conductor 18*a*, which is positioned on the most negative side in the y-axis direction, is connected to the outer electrode 14*a*. The outer conductor 25*a*, to which the extended conductor 40*a* is connected, does not reach the corner between the bottom surface S2 and the end surface S3. In this manner, the coil L is connected to a portion in the outer electrode 14*a* that protrudes in the y-axis direction (that is, outer conductor 25*a*).

The extended conductor 40*b* is disposed on the front surface of the insulating layer 16*m* and connects the end portion of the coil conductor 18*j* on the downstream side in the clockwise direction and the outer conductor 35*j*. The extended conductor 40*b* does not overlap the route R. The coil conductor 18*j*, which is positioned on the most positive side in the y-axis direction, is connected to the outer electrode 14*b*. The outer conductor 35*j*, to which the extended conductor 40*b* is connected, does not reach the corner between the bottom surface S2 and the end surface S4. In this manner, the coil L is connected to a portion in the outer electrode 14*b* that protrudes in the y-axis direction (that is, outer conductor 35*j*).

In the electronic component 10 having the above-described configuration, a distance D1 between the outer electrode 14*a* and the side surface S6 in the corner between the bottom surface S2 and the end surface S3 is longer than a distance D2 between the outer conductor 25*a*, which is the portion where the outer electrode 14*a* and the coil L are connected, and the side surface S6. A distance D3 between the outer electrode 14*a* and the side surface S5 in the corner between the bottom surface S2 and the end surface S3 is longer than a distance D4 between the outer conductor 25*j* and the side surface S5. Each of the distances D1 and D3 may preferably be equal to or longer than 10 μm.

The corners of the multilayer body 12 in the electronic component 10 are rounded by chamfering. Accordingly, the distance between the outer electrode 14*a* and the side surface S6 in the corner between the bottom surface S2 and the end surface S3 is the shortest distance from the outer electrode 14*a* to the intersection of an extension line of the ridge line between the bottom surface S2 and the end surface S3 and a plane extended from the side surface S6. Similarly, the distance between the outer electrode 14*a* and the side surface S5 in the corner between the bottom surface S2 and the end surface S3 is the shortest distance from the outer electrode 14*a* to the intersection of an extension line of the ridge line between the bottom surface S2 and the end surface S3 and a plane extended from the side surface S5.

A distance D5 between the outer electrode 14*b* and the side surface S6 in the corner between the bottom surface S2 and the end surface S4 is longer than a distance D6 between the outer conductor 35*a* and the side surface S6. A distance D7 between the outer electrode 14*b* and the side surface S5 in the corner between the bottom surface S2 and the end surface S4 is longer than a distance D8 between the outer conductor 35*j*, which is the portion where the outer electrode 14*b* and the coil L are connected, and the side surface S5. Each of the distances D5 and D7 may preferably be equal to or longer than 10 μm.

The distance between the outer electrode 14*b* and the side surface S6 in the corner between the bottom surface S2 and the end surface S4 is the shortest distance from the outer electrode 14*b* to the intersection of an extension line of the ridge line between the bottom surface S2 and the end surface S4 and a plane extended from the side surface S6. Similarly, the distance between the outer electrode 14*b* and the side surface S5 in the corner between the bottom surface S2 and the end surface S4 is the shortest distance from the outer electrode 14*b* to the intersection of an extension line of the ridge line between the bottom surface S2 and the end surface S4 and a plane extended from the side surface S5.

Method for Manufacturing Electronic Component

A method for manufacturing the electronic component 10 according to the present embodiment is described below with reference to the drawings. FIGS. 3 to 8 are plan views in manufacturing the electronic component 10.

Figure 3:
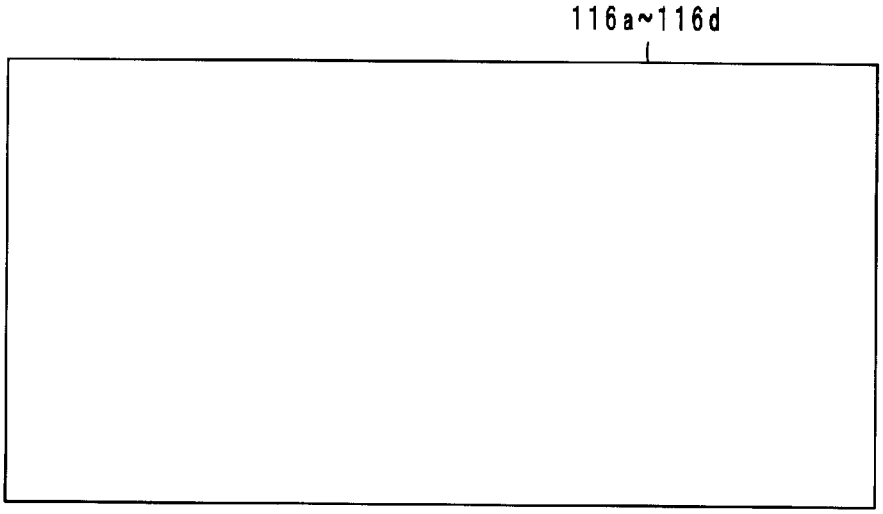
FIG. 3 is a plan view in manufacturing the electronic component.

First, as illustrated in FIG. 3, insulating paste layers 116*a* to 116*d* are formed by repeatedly applying the insulating paste whose main ingredient is a borosilicate glass by screen-printing. The insulating paste layers 116*a* to 116*d* are paste layers that are to be the insulating layers 16*a* to 16*d*, which are external insulating layers positioned outside the coil L.

Figure 4:
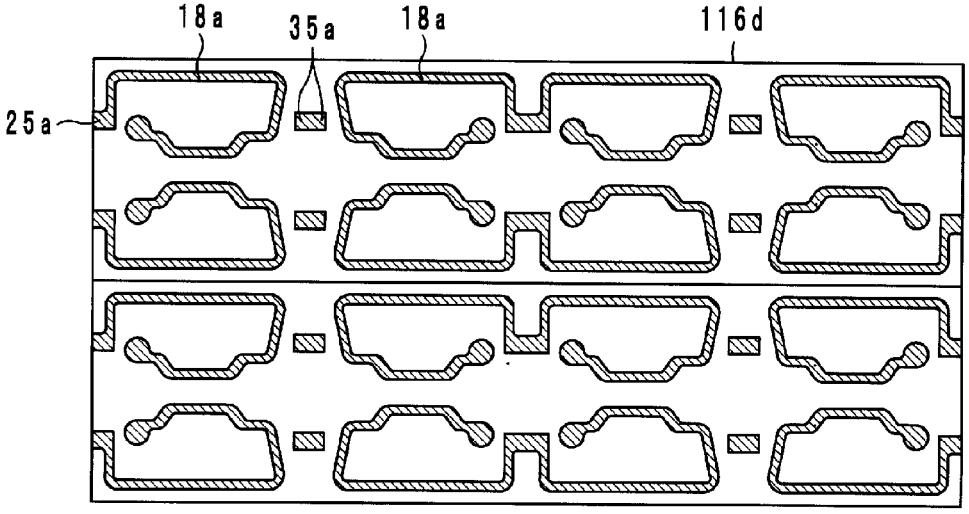
FIG. 4 is a plan view in manufacturing the electronic component.

Next, as illustrated in FIG. 4, the coil conductors 18*a* and the outer conductors 25*a* and 35*a* are formed by a photolithographic process. Specifically, a conductive paste layer is formed on the insulating paste layer 116*d* by applying photosensitive conductive paste having silver as a metal main ingredient by screen-printing. Then, the conductive paste layer is irradiated with ultraviolet rays or the like through a photomask and is developed by using an alkali solution or the like. In this manner, the outer conductors 25*a* and 35*a* and the coil conductors 18*a* are formed on the insulating paste layer 116*d*.

Figure 5:
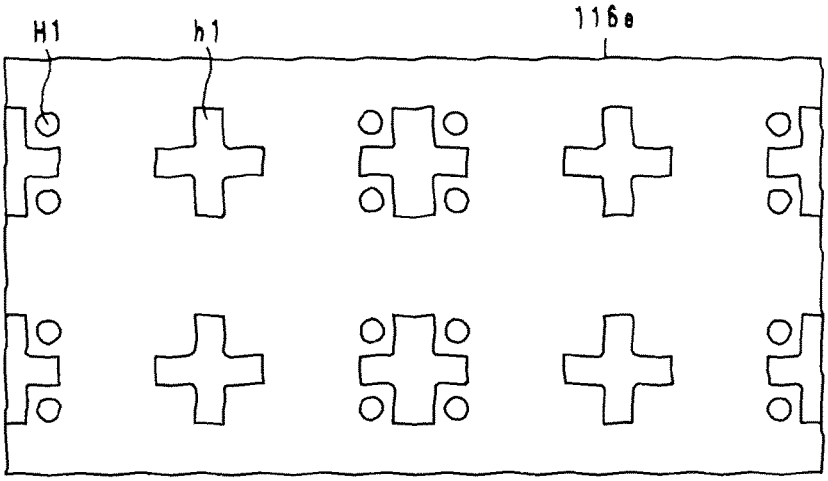
FIG. 5 is a plan view in manufacturing the electronic component.

Next, as illustrated in FIG. 5, an insulating paste layer 116*e* with apertures h1 and via holes H1 is formed by a photolithographic process. Specifically, an insulating paste layer is formed on the insulating paste layer 116*d* by applying photosensitive insulating paste by screen-printing. Then, the insulating paste layer is irradiated with ultraviolet rays or the like through a photomask and is developed by using an alkali solution or the like. The insulating paste layer 116*e* is a paste layer that is to be the insulating layer 16*e*. Each of the apertures h1 is a cruciform hole in which four outer conductors 25*b* or four outer conductors 35*b* are combined.

Figure 6:
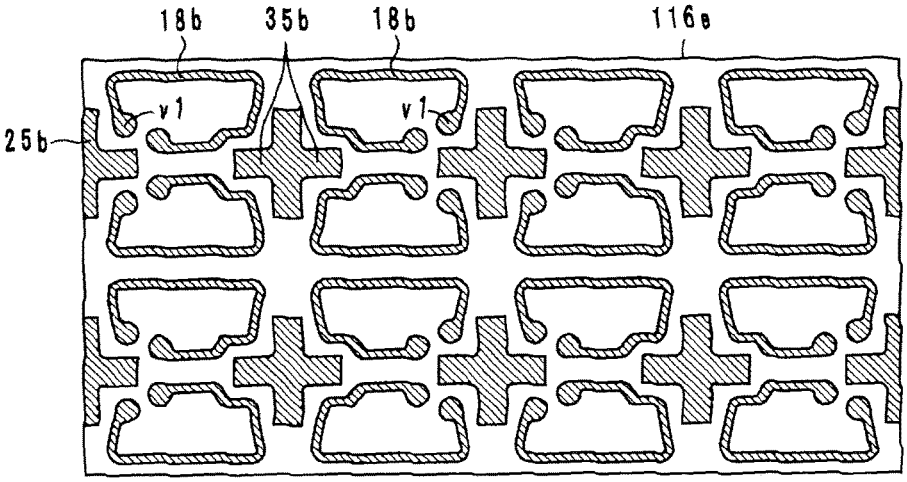
FIG. 6 is a plan view in manufacturing the electronic component.

Next, as illustrated in FIG. 6, the coil conductors 18*b*, outer conductors 25*b* and 35*b*, and via-hole conductors v1 are formed by a photolithographic process. Specifically, a conductive paste layer is formed on the insulating paste layer 116*e* and inside the apertures h1 and via holes H1 by applying photosensitive conductive paste having silver as a metal main ingredient by screen-printing. Then, the conductive paste layer is irradiated with ultraviolet rays or the like through a photomask and is developed by using an alkali solution or the like. In this manner, the outer conductors 25*b* and 35*b* are formed inside the apertures h1, the via-hole conductors v1 are formed inside the via holes H1, and the coil conductors 18*b* are formed on the insulating paste layer 116*e*.

Figure 7:
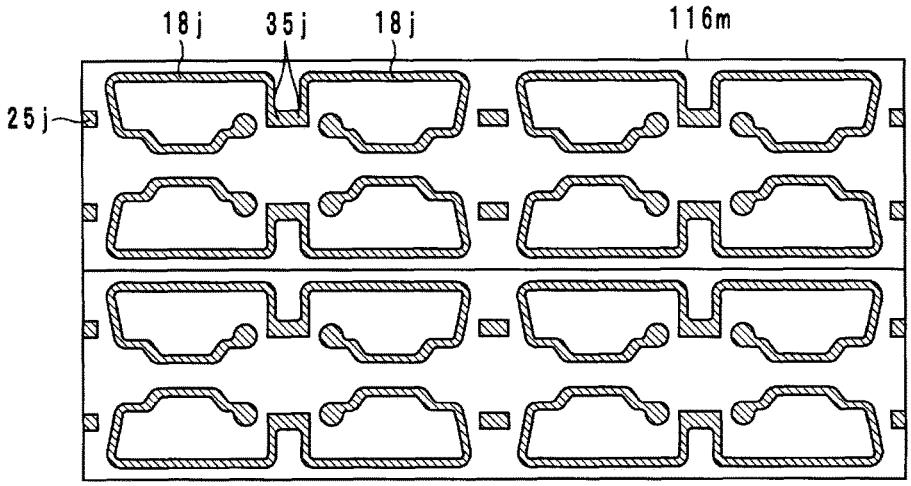
FIG. 7 is a plan view in manufacturing the electronic component.

After that, insulating paste layers 116*f* to 116*m*, the coil conductors 18*c* to 18*j*, outer conductors 25*c* to 25*j* and 35*c* to 35*j*, and via-hole conductors v2 to v10 are formed by repeating the same processes as those illustrated in FIGS. 5 and 6. In this manner, as illustrated in FIG. 7, the coil conductors 18*j* and outer conductors 25*j* and 35*j* are formed on the insulating paste layer 116*m*.

Figure 8:
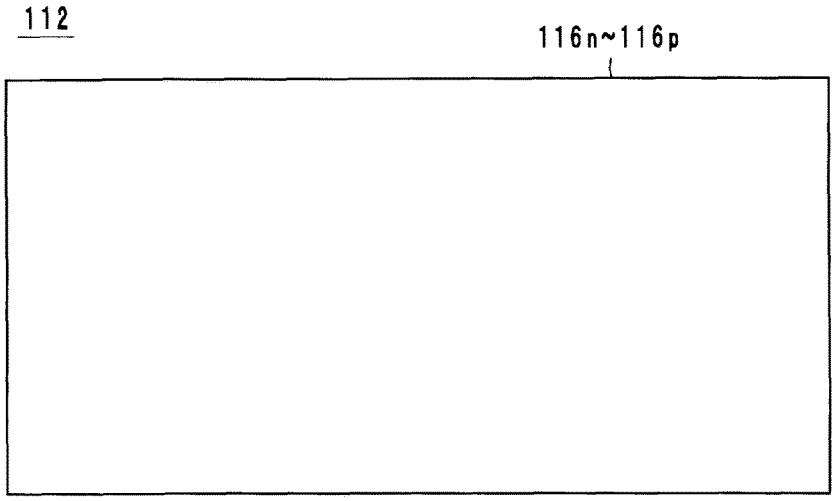
FIG. 8 is a plan view in manufacturing the electronic component.

Next, as illustrated in FIG. 8, insulating paste layers 116*n* to 116*p* are formed by repeating the application of the insulating paste by screen-printing. The insulating paste layers 116*n* to 116*p* are paste layers that are to be the insulating layers 16*n* to 16*p*, which are external insulating layers positioned outside the coil L. A mother multilayer body 112 is obtained through the above-described processes.

Next, the mother multilayer body 112 is cut into a plurality of unfired multilayer bodies 12 by using a dicing machine or the like. In the process for cutting the mother multilayer body 112, the outer electrodes 14*a* and 14*b* are exposed from each of the multilayer bodies 12 at surfaces formed by the cutting.

Next, the unfired multilayer bodies 12 are fired under a predetermined condition, and the fired multilayer bodies 12 are obtained. Then, the multilayer bodies 12 are subjected to barrel polishing.

Lastly, tin plating having a thickness of 2 μm to 7 μm and nickel plating having a thickness of 2 μm to 7 μm are applied to the portions where the outer electrodes 14*a* and 14*b* are exposed from each of the multilayer bodies 12. The electronic components 10 are completed through the above-described processes.

Advantages

According to the electronic component 10 having the above-described configuration, the occurrence of chipping in the multilayer body 12 can be suppressed. More specifically, the distance D1 between the outer electrode 14*a* and the side surface S6 in the corner between the bottom surface S2 and the end surface S3 is longer than the distance D2 between the outer conductor 25*a* and the side surface S6. Thus the portion between the outer electrode 14*a* and the side surface S6, that portion being likely to have chipping in the multilayer body 12, can have an increased thickness. Accordingly, the strength of the portion between the outer electrode 14*a* and the side surface S6 can be improved. This leads to suppressing the occurrence of chipping in the multilayer body 12. For the same reason as for the portion between the outer electrode 14*a* and the side surface S6, the occurrence of chipping in the multilayer body 12 can be suppressed in the portion between the outer electrode 14*a* and the side surface S5, the portion between the outer electrode 14*b* and the side surface S5, and the portion between the outer electrode 14*b* and the side surface S6.

According to the electronic component 10, the coil L can have an increased inductance value. More specifically, the coil conductor 18*a*, which is positioned in the most negative side in the y-axis direction, is connected to the outer conductor 25*a*, which is positioned in the most negative side in the y-axis direction in the outer electrode 14*a*. Thus the end portion of the coil L on the negative side in the y-axis direction can be close to the side surface S6. This can lead to an increased length of the coil L in the y-axis direction and can lead to an increased inductance value of the coil L.

Similarly, the coil conductor 18*m*, which is positioned on the most positive side in the y-axis direction, is connected to the outer conductor 35*j*, which is positioned on the most positive side in the y-axis direction in the outer electrode 14*b*. Thus the end portion of the coil L on the positive side in the y-axis direction can be close to the side surface S5. This can lead to an increased length of the coil L in the y-axis direction and can lead to an increased inductance value of the coil L. As described above, according to the electronic component 10, the occurrence of chipping in the multilayer body 12 can be suppressed, and the inductance value of the coil L can be increased.

The inventor conducted an experiment described below to find preferable values of the distances D1, D3, D5, and D7. More specifically, three kinds of the electronic components 10 in which each of the distances D1, D3, D5, and D7 was 4 μm, 18 μm, and 33 μm were produced, and 125 units were produced for each of the three kinds of the electronic components 10. Hereinafter, the electronic components 10 in which each of the distances D1, D3, D5, and D7 is 4 μm are referred to as first samples, the electronic components 10 in which each of the distances D1, D3, D5, and D7 is 18 μm are referred to as second samples, and the electronic components 10 in which each of the distances D1, D3, D5, and D7 is 33 μm are referred to as third samples. The description in which each of the distances D1, D3, D5, and D7 was 4 μm, 18 μm, and 33 μm means that the average value of each of the distances D1, D3, D5, and D7 in the 125 units is 4 μm, 18 μm, and 33 μm. The number of each of the first to third samples having chipping in the multilayer bodies 12 that occurred in barrel polishing in the manufacturing process was counted.

Figure 9:
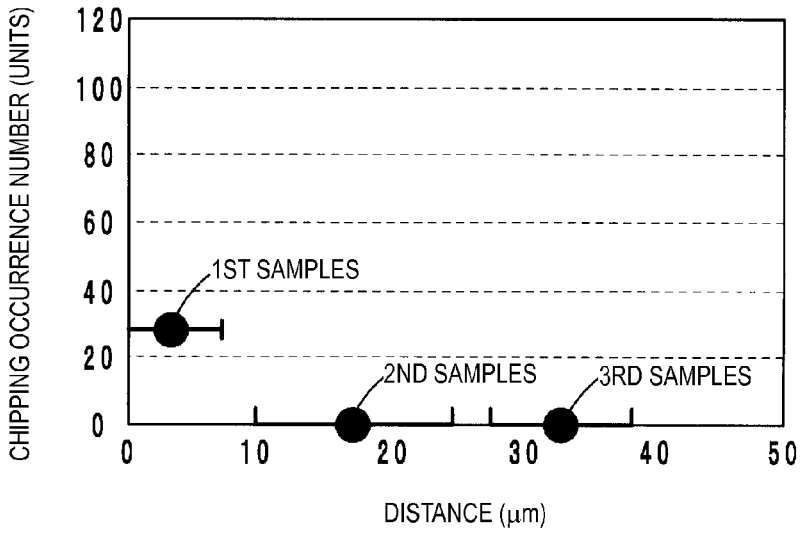
FIG. 9 is a graph that represents experimental results.

FIG. 9 is a graph that represents experimental results. The vertical axis indicates the number of units in which chipping occurred (chipping occurrence number), and the horizontal axis indicates the distances D1, D3, D5, and D7 (distance). In FIG. 9, an error bar of 2σ for the area where each of the distances D1, D3, D5, and D7 falls within a range of 2σ is illustrated.

FIG. 9 reveals that the chipping occurrence number reduces with an increase in the distance. Chipping occurred in some units in the first samples, in which the distance was 4 μm, whereas no chipping occurred in the second samples, in which the distance was 18 μm, and in the third samples, in which the distance was 33 μm. Accordingly, the distances D1, D3, D5, and D7 may preferably be equal to or longer than 18 μm. The error bar of the range 26 for the second samples is in the range of from 10 μm to 25 μm. That is, the distances D1, D3, D5, and D7 in 95.5% of the second samples fall within the range of from 10 μm to 25 μm. Because the number of units tested in the experiment is 125, from the probability, at least two units among the second samples are considered to have the distances D1, D3, D5, and D7 being equal to or smaller than 10 μm. Because chipping did not occur in any of the 125 second samples, it is confirmed that no chipping occurs when each of the distances D1, D3, D5, and D7 is equal to or longer than at least 10 μm.

Variations

Figure 10:
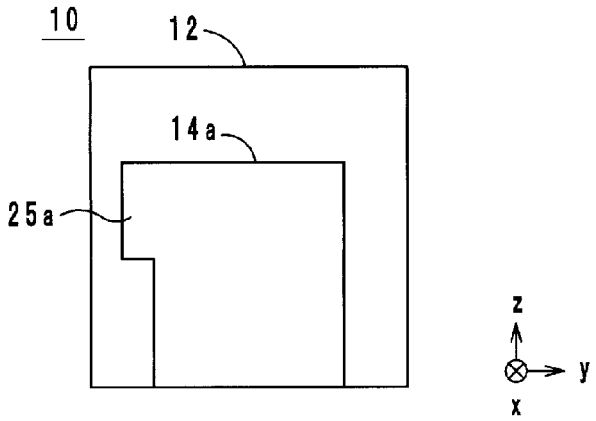
FIG. 10 is an illustration of an outer electrode according to a first variation as seen from a negative side in an x-axis direction in plan view.

The outer electrodes 14*a* and 14*b* according to a first variation are described below with reference to FIG. 10. FIG. 10 is an illustration of the outer electrode 14*a* according to the first variation as seen from the negative side in the x-axis direction in plan view.

In the outer electrode 14*a* according to the first variation, the outer conductor 25*a* protrudes from the long side of the portion where the outer electrode 14*a* is exposed at the end surface S3 on the negative side in the y-axis direction, toward the negative side in the y-axis direction. In contrast, the outer conductor 25*j* does not protrude from the long side of the portion where the outer electrode 14*a* is exposed at the end surface S3 on the positive side in the y-axis direction, toward the positive side in the y-axis direction. As in this example, it is merely required that the portion connected to the coil L in the outer electrode 14*a* (that is, outer conductor 25*a*) protrude from the long side of the portion where the outer electrode 14*a* is exposed at the end surface S3 on the negative side in the y-axis direction, toward the negative side in the y-axis direction, and it is not required that the portion not connected to the coil L in the outer electrode 14*a* (that is, outer conductor 25*j*) protrude from the long side of the portion where the outer electrode 14*a* is exposed at the end surface S3 on the negative side in the y-axis direction, toward the negative side in the y-axis direction. The outer electrode 14*b* may have the same structure as in the outer electrode 14*a* illustrated in FIG. 10.

Figure 11:
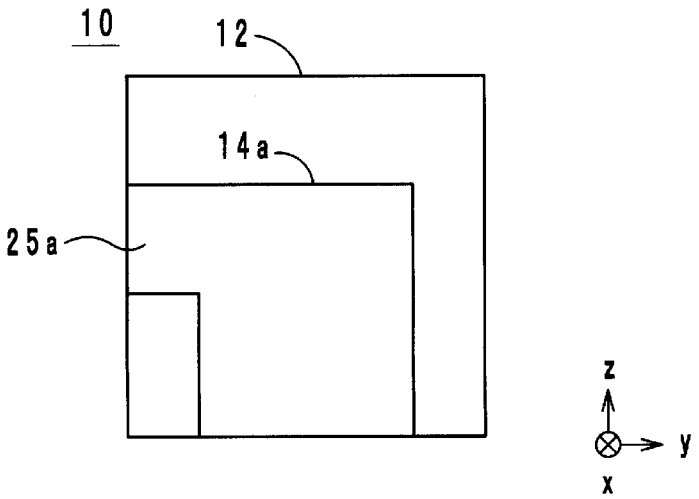
FIG. 11 is an illustration of an outer electrode according to a second variation as seen from the negative side in the x-axis direction in plan view.

Next, the outer electrodes 14*a* and 14*b* according to a second variation are described with reference to FIG. 11. FIG. 11 is an illustration of the outer electrode 14*a* according to the second variation as seen from the negative side in the x-axis direction in plan view.

In the outer electrode 14*a* according to the second variation, the outer conductor 25*a* protrudes from the long side of the portion where the outer electrode 14*a* is exposed at the end surface S3 on the negative side in the y-axis direction, toward the negative side in the y-axis direction. The outer conductor 25*a* reaches the side surface S6. The outer electrode 14*b* may have the same structure as in the outer electrode 14*a* illustrated in FIG. 11.

Figure 12:
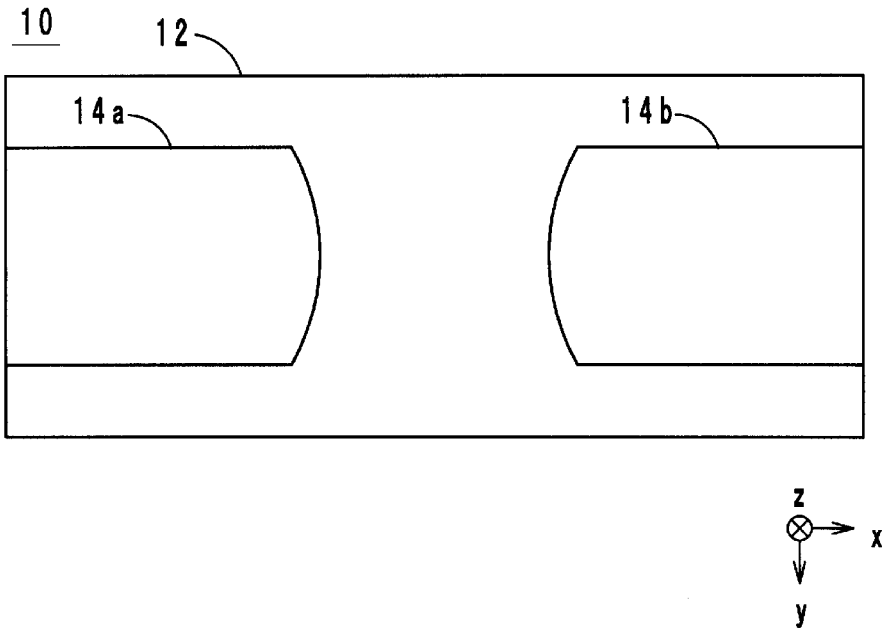
FIG. 12 is an illustration of outer electrodes according to a third variation as seen from a negative side in a z-axis direction in plan view.

Next, the outer electrodes 14*a* and 14*b* according to a third variation are described with reference to FIG. 12. FIG. 12 is an illustration of the outer electrodes 14*a* and 14*b* according to the third variation as seen from the negative side in the z-axis direction in plan view.

The short side of the outer electrode 14*a* on the positive side in the x-axis direction may be gently curved such that it protrudes toward the positive side in the x-axis direction as seen from the negative side in the z-axis direction in plan view. Similarly, the short side of the outer electrode 14*b* on the negative side in the x-axis direction may be gently curved such that it protrudes toward the negative side in the x-axis direction as seen from the negative side in the z-axis direction in plan view.

Figure 13:
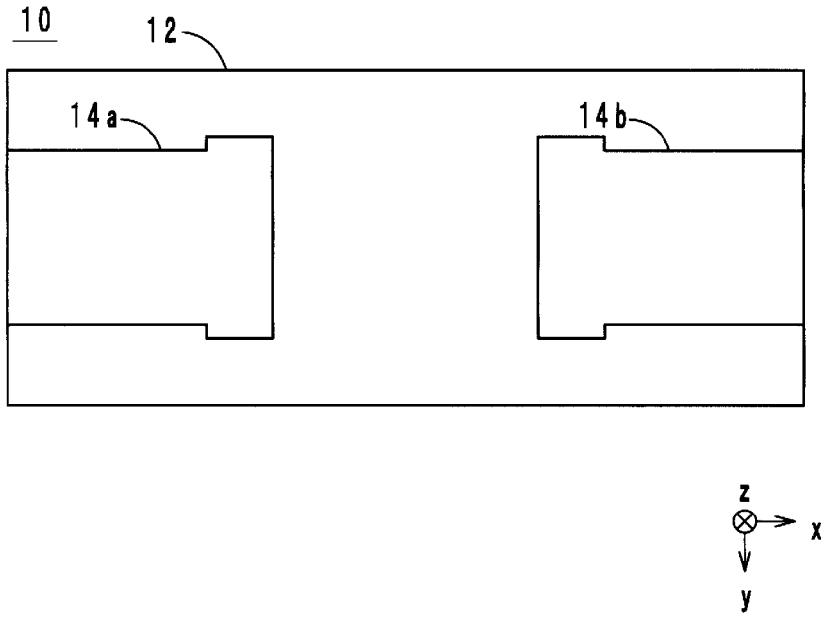
FIG. 13 is an illustration of outer electrodes according to a fourth variation as seen from the negative side in the z-axis direction in plan view.

Next, the outer electrodes 14*a* and 14*b* according to a fourth variation are described with reference to FIG. 13. FIG. 13 is an illustration of the outer electrodes 14*a* and 14*b* according to the fourth variation as seen from the negative side in the z-axis direction in plan view.

The end portion in the outer electrode 14*a* on the positive side in the x-axis direction may protrude toward both sides in the y-axis direction. Similarly, the end portion in the outer electrode 14*b* on the negative side in the x-axis direction may protrude toward both sides in the y-axis direction. The extended conductors 40*a* and 40*b* may preferably be connected to the portions protruding toward both sides in the y-axis direction in the outer electrodes 14*a* and 14*b*, respectively.

Figure 14:
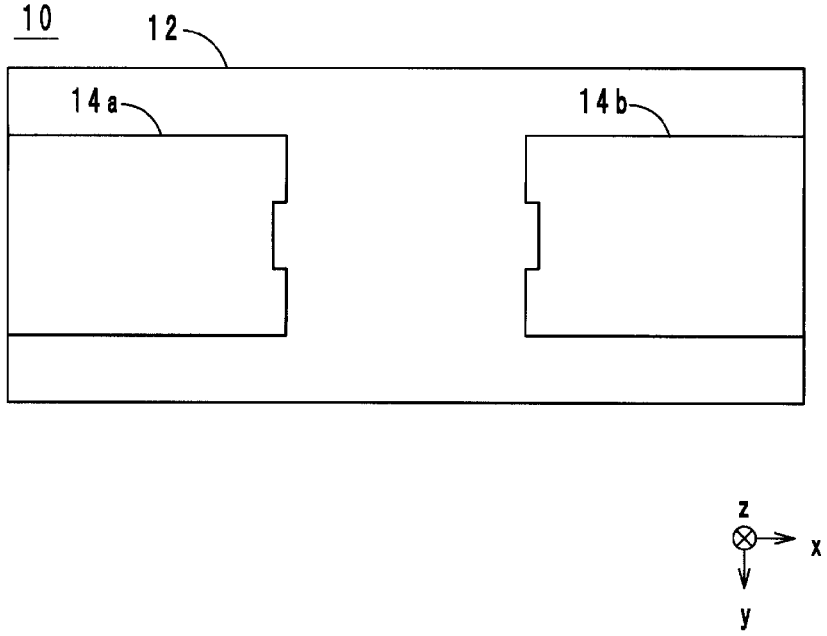
FIG. 14 is an illustration of outer electrodes according to a fifth variation as seen from the negative side in the z-axis direction in plan view.

Next, the outer electrodes 14*a* and 14*b* according to a fifth variation are described with reference to FIG. 14. FIG. 14 is an illustration of the outer electrodes 14*a* and 14*b* according to the fifth variation as seen from the negative side in the z-axis direction in plan view.

Both ends of the short side of the outer electrode 14*a* on the positive side in the x-axis direction may protrude toward the positive side in the x-axis direction. Similarly, both ends of the short side of the outer electrode 14*b* on the negative side in the x-axis direction may protrude toward the negative side in the x-axis direction. The extended conductor 40*a* may preferably be connected to the portion in the outer electrode 14*a* protruding toward the positive side in the x-axis direction. The extended conductor 40*b* may preferably be connected to the portion in the outer electrode 14*b* protruding toward the negative side in the x-axis direction.

Figure 15:
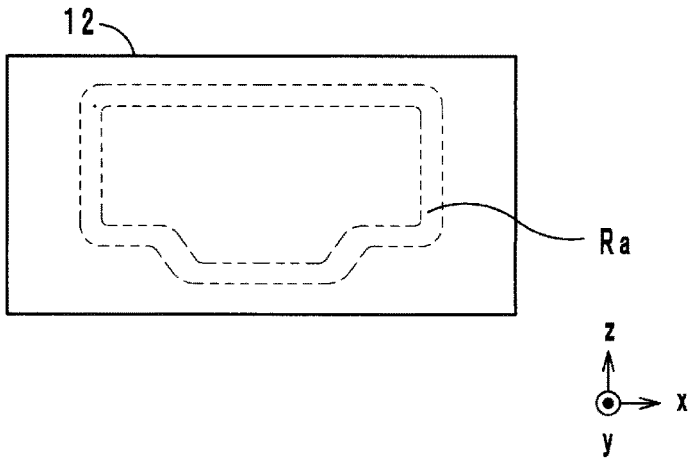
FIG. 15 illustrates a route according to the first variation.

Next, a route Ra according to the first variation is described with reference to FIG. 15. FIG. 15 illustrates the route Ra according to the first variation.

The route Ra may be substantially rectangular. In the route Ra, the two corners of the long side on the negative side in the z-axis direction and their surroundings are recessed inward in the route Ra so as not to be in contact with the outer electrodes 14*a* and 14*b*.

Figure 16:
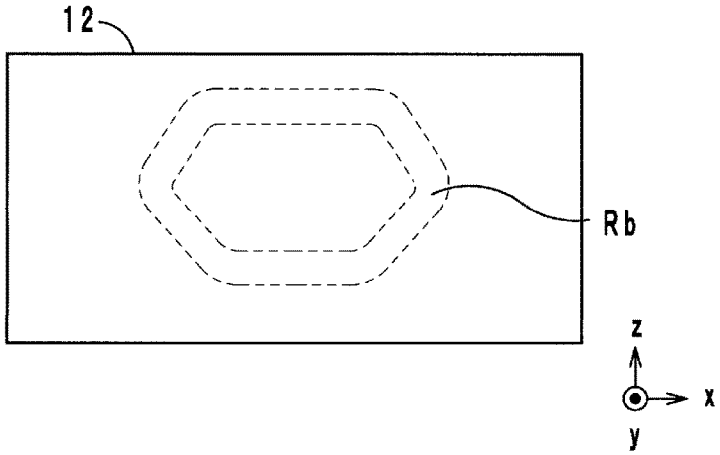
FIG. 16 illustrates a route according to the second variation.

Next, a route Rb according to the second variation is described with reference to FIG. 16. FIG. 16 illustrates the route Rb according to the second variation.

The route Rb may be substantially hexagonal.

Figure 17:
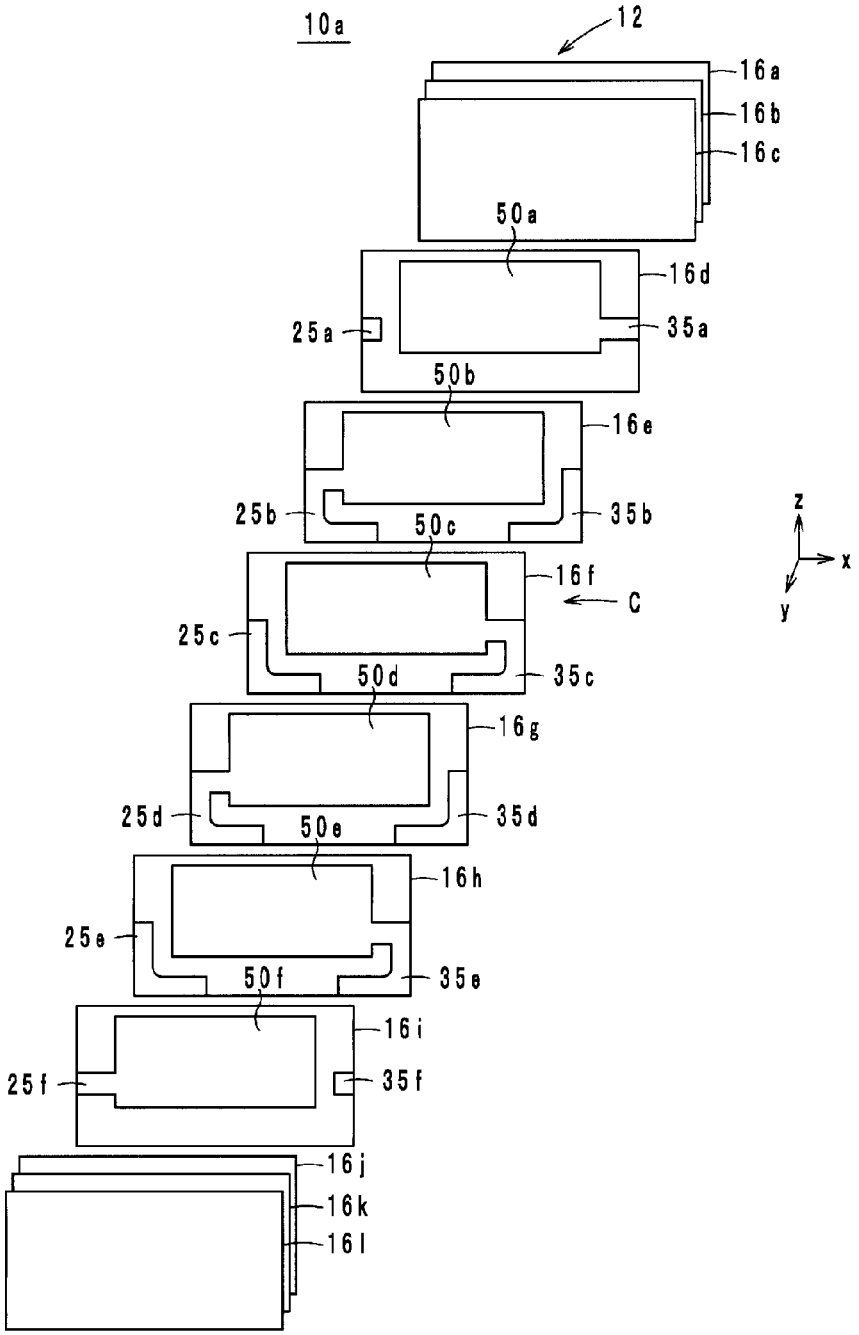
FIG. 17 is an exploded perspective view of an electronic component according to a variation.
Figure 18:
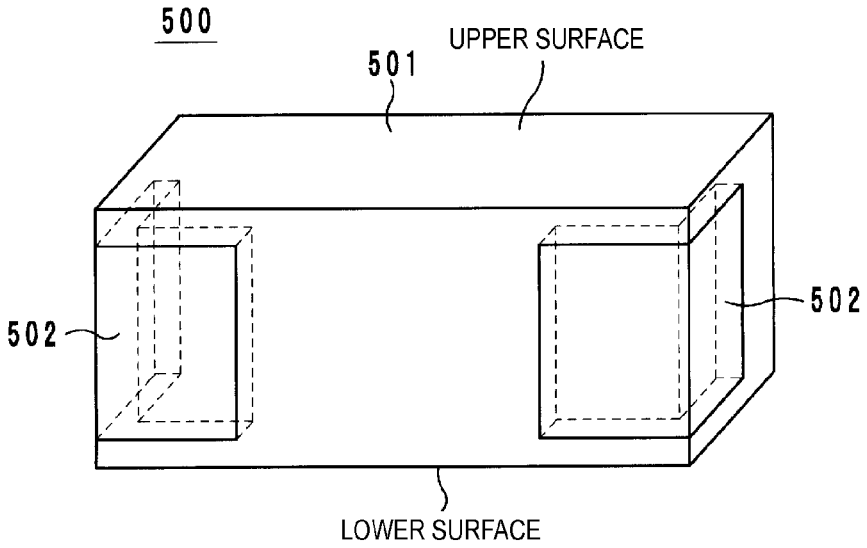
FIG. 18 PRIOR ART
FIG. 18 is a perspective view of a multilayer chip inductor described in Japanese Unexamined Patent Application Publication No. 2012-79870.

Next, an electronic component 10*a* according to a variation is described. FIG. 17 is an exploded perspective view of the electronic component 10*a* according to the variation.

The electronic component 10 includes the coil L as the circuit element. The electronic component 10*a* includes a capacitor C as the circuit element. More specifically, the capacitor C includes capacitor conductors 50*a* to 50*f*.

The capacitor conductors 50*a* to 50*f* are disposed on the front surfaces of the insulating layers 16*d* to 16*i*, respectively, and are substantially rectangular. Of the capacitor conductors 50*a* to 50*f*, the neighboring ones in the y-axis direction are opposed to each other through the insulating layers 16*e* to 16*i*.

The outer conductors 25*a* to 25*e* in the electronic component 10*a* have the same shapes as in the outer conductors 25*a* to 25*e* in the electronic component 10, respectively. The outer conductor 25*f* in the electronic component 10*a* has the same shape as in the outer conductor 25*j* in the electronic component 10. The outer conductors 25*b*, 25*d*, and 25*f* are connected to the capacitor conductors 50*b*, 50*d*, and 50*f*, respectively.

The outer conductors 35*a* to 35*e* in the electronic component 10*a* have the same shapes as in the outer conductors 35*a* to 35*e* in the electronic component 10, respectively. The outer conductor 35*f* in the electronic component 10*a* has the same shape as in the outer conductor 35*j* in the electronic component 10. The outer conductors 35*a*, 35*c*, and 35*e* are connected to the capacitor conductors 50*a*, 50*c*, and 50*e*, respectively.

The occurrence of chipping in the multilayer body 12 can also be suppressed in the electronic component 10*a* having the above-described configuration, as in the electronic component 10.

The capacitor C in the electronic component 10*a* can have an increased capacitance. More specifically, the capacitor conductor 50*a*, which is positioned on the most negative side in the y-axis direction, is connected to the outer conductor 35*a*, which is positioned on the most negative side in the y-axis direction in the outer electrode 14*b*. Thus the end portion of the capacitor C on the negative side in the y-axis direction can be close to the side surface S6. This can lead to an increased number of laminated layers in the capacitor C and lead to an increased capacitance of the capacitor C.

The capacitor conductor 50*f*, which is positioned on the most positive side in the y-axis direction, is connected to the outer conductor 25*f*, which is positioned on the most positive side in the y-axis direction in the outer electrode 14*a*. Thus the end portion of the capacitor C on the positive side in the y-axis direction can be close to the side surface S5. This can lead to an increased number of laminated layers in the capacitor C and lead to an increased capacitance of the capacitor C.

Other Embodiment

An electronic component according to the present disclosure is not limited to the electronic components 10 and 10*a* in the above-described embodiment and may be changed within the scope of the disclosure.

The circuit element, which is the coil L in the electronic component 10 and is the capacitor C in the electronic component 10*a*, may alternatively be a circuit element other than the coil L and the capacitor C, and it may be any combination thereof.

The coil L and the capacitor C, which are connected to the outer electrodes 14*a* and 14*b* at the end surfaces S3 and S4, may be connected at the bottom surface S2.

INDUSTRIAL APPLICABILITY

As described above, the present disclosure is useful in electronic components and, in particular, is advantageous in that the occurrence of chipping in a multilayer body can be suppressed.

The invention claimed is:

1. An electronic component comprising:

a multilayer body in which a plurality of substantially rectangular insulating layers are laminated, the multilayer body having a bottom surface being a series of outer edges of the plurality of insulating layers, a first end surface being adjacent to the bottom surface and being a series of the outer edges of the plurality of insulating layers, a first side surface being located on a first side in a laminating direction, and a second side surface located on a side opposite to the first side surface;

a first outer electrode embedded in the multilayer body such that the first outer electrode is exposed from the multilayer body while extending across a boundary between the bottom surface and the first end surface; and a circuit element disposed in the multilayer body and connected to the first outer electrode, wherein a distance between the first outer electrode and the first side surface in a corner between the bottom surface and the first end surface is longer than a distance between the first outer electrode and the first side surface in a portion where the first outer electrode and the circuit element are connected, and a distance between the first outer electrode and the second side surface in a corner between the bottom surface and the first end surface is equal to a distance between the first outer electrode and the second side surface in a portion where the first outer electrode and the circuit element are connected.

* * * * *